US011432651B2

(12) United States Patent
Pao

(10) Patent No.: US 11,432,651 B2
(45) Date of Patent: Sep. 6, 2022

(54) FOLDING MECHANISM AND FOLDABLE CHAIR WITH THE SAME

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 0 days.

(21) Appl. No.: 17/342,419

(22) Filed: Jun. 8, 2021

(65) Prior Publication Data

US 2022/0061535 A1 Mar. 3, 2022

(30) Foreign Application Priority Data

Aug. 25, 2020 (TW) ..... 109128974

(51) Int. Cl.

| | |
|---|---|
| ***A47B 3/00*** | (2006.01) |
| ***A47B 5/00*** | (2006.01) |
| ***A47C 9/10*** | (2006.01) |
| ***A47C 4/04*** | (2006.01) |
| ***A47C 4/18*** | (2006.01) |

(52) U.S. Cl.
CPC ..... *A47C 4/04* (2013.01)

(58) Field of Classification Search
CPC ..... A47C 4/04; A47C 9/105; A47C 4/286
See application file for complete search history.

(56) References Cited

U.S. PATENT DOCUMENTS

| | | | | |
|---|---|---|---|---|
| 1,845,921 | A * | 2/1932 | Karwoski | A47C 9/105 248/164 |
| 4,934,638 | A * | 6/1990 | Davis | A47C 9/105 108/118 |
| 5,851,052 | A * | 12/1998 | Gustafsson | A47C 4/286 297/16.2 |
| 5,921,621 | A * | 7/1999 | Cook | A47C 4/286 297/16.2 |
| 7,367,617 | B1 | 5/2008 | Bond | |
| 8,997,766 | B2 * | 4/2015 | Pao | A47C 4/04 297/16.2 |
| D733,477 | S * | 7/2015 | Sutton | D6/716 |
| 9,357,820 | B2 * | 6/2016 | Pao | A45B 5/00 |
| 9,414,655 | B2 * | 8/2016 | Pao | A45B 5/00 |
| 9,504,297 | B2 * | 11/2016 | Pao | A47C 4/04 |
| 9,681,713 | B2 * | 6/2017 | Pao | A45B 5/00 |
| 10,064,462 | B2 * | 9/2018 | Pao | A45B 5/00 |
| D894,585 | S * | 9/2020 | Ye | D3/7 |

(Continued)

OTHER PUBLICATIONS

A Search Report, which was issued to European counterpart application No. 21178077.0 by the EPO dated Dec. 3, 2021.

*Primary Examiner* — Shin H Kim
(74) *Attorney, Agent, or Firm* — DLA Piper LLP (US)

(57) ABSTRACT

A folding mechanism includes a pivot seat unit and at least three support units disposed about an axial line and pivotally connected to the pivot seat unit. Each of the support units includes a support rod. Rotation of any one of the support rods of the support units relative to the pivot seat unit drives an adjacent one of the support rods to rotate, such that when any one of the support rods is rotated relative to the pivot seat unit, the other support rods are in turn driven to rotate relative to the pivot seat unit so as to convert the support units between a folded state and an unfolded state.

15 Claims, 21 Drawing Sheets

(56) References Cited

U.S. PATENT DOCUMENTS

| | | | | |
|---|---|---|---|---|
| D899,071 | S * | 10/2020 | You | D3/7 |
| 11,226,064 | B2 * | 1/2022 | Pao | A47F 5/0006 |
| 2014/0034097 | A1 * | 2/2014 | Pao | A45B 5/00 135/66 |
| 2014/0034098 | A1 * | 2/2014 | Pao | A45B 5/00 135/66 |
| 2014/0060598 | A1 * | 3/2014 | Pao | A45B 5/00 135/66 |
| 2015/0107636 | A1 * | 4/2015 | Pao | A45B 5/00 135/66 |
| 2015/0196103 | A1 * | 7/2015 | Pao | A47C 9/105 297/55 |
| 2015/0265012 | A1 * | 9/2015 | Pao | A45B 5/00 135/66 |
| 2015/0327636 | A1 * | 11/2015 | Pao | A45B 5/00 135/66 |
| 2017/0086542 | A1 * | 3/2017 | Pao | A45B 5/00 |
| 2021/0285595 | A1 * | 9/2021 | Pao | F16M 11/38 |
| 2022/0061535 | A1 * | 3/2022 | Pao | A47C 9/105 |

* cited by examiner

FOLDING MECHANISM AND FOLDABLE CHAIR WITH THE SAME

CROSS-REFERENCE TO RELATED APPLICATION

This application claims priority to Taiwanese Invention Patent Application No. 109128974, filed on Aug. 25, 2020.

FIELD

The disclosure relates to a folding mechanism, and more particularly to a folding mechanism and a foldable chair with the folding mechanism.

BACKGROUND

A conventional foldable chair disclosed in Taiwanese Utility Model Patent No. M467398 includes a base seat that is formed with a plurality of pivot grooves, and a plurality of support legs that respectively extend through the pivot grooves and that are pivotally connected to the base seat. The conventional foldable chair is convertible between a folded state in which the support legs are parallel to each other, and an unfolded state in which the support legs are oblique to each other. The conventional foldable chair may be used as a cane when folded, and converts into a chair in the unfolded state. However, during the conversion of the conventional foldable chair from the folded state to the unfolded state, the support legs need to be individually operated. Although the conventional foldable chair may be folded or unfolded as required by a user, the individual operation of the support legs during the conversion could be slow and frustrating for the user. Especially for elderly users who may have to rely on the cane function of the conventional foldable chair for support, such users would find the conversion of the conventional foldable chair laborious.

SUMMARY

Therefore, an object of the disclosure is to provide a folding mechanism that can alleviate the drawback of the prior art.

According to the disclosure, the folding mechanism includes a pivot seat unit and at least three support units. The pivot seat unit includes at least three pivot pins that are angularly spaced apart from each other about an axial line. Each of the pivot pins has a central line. The support units are disposed about the axial line. Each of the support units includes a support rod that has an extending axis, and a push member that is fixedly connected to the support rod. The support rod of each of the support units has a first end portion, a second end portion that is opposite to the first end portion along the extending axis, and a pivot portion that is located between the first end portion and the second end portion and that is pivotally connected to a respective one of the pivot pins. The push member of each of the support units is located between the pivot portion and the second end portion of the support rod of the support unit, and has first and second push surfaces. The support units are convertible between a folded state and an unfolded state. When the support units are in the folded state, the first end portions of the support rods of the support units are proximate to the axial line, the second end portions of the support rods of the support units are proximate to the axial line, and for each of the push members of the support units, the first push surface of the push member faces the second push surface of an adjacent one of the push members, and the second push surface of the push members faces the first push surface of the other adjacent one of the push members. When the support units are in the unfolded state, the first end portions of the support rods of the support units are distal from the axial line, and the second end portions of the support rods of the support units are distal from the axial line. Rotation of any one of the support rods of the support units relative to the pivot seat unit drives a circumferentially adjacent one of the support rods to rotate, such that when any one of the support rods is rotated relative to the pivot seat unit about the central line of the respective one of the pivot pins, the others of the support rods are in turn driven to rotate relative to the pivot seat unit so as to convert the support units between the folded state and the unfolded state.

Another object of the disclosure is to provide a foldable chair that can alleviate the drawback of the prior art.

According to the disclosure, the foldable chair includes a pivot seat unit, at least three support units and a sitting unit. The pivot seat unit includes at least three pivot pins that are angularly spaced apart from each other about an axial line, and a connecting member. Each of the pivot pins has a central line. The support units are disposed about the axial line. Each of the support units includes a support rod that has an extending axis, and a push member that is fixedly connected to the support rod. The support rod of each of the support units has a first end portion, a second end portion that is opposite to the first end portion along the extending axis, and a pivot portion that is located between the first end portion and the second end portion and that is pivotally connected to a respective one of the pivot pins. The push member of each of the support units is located between the pivot portion and the second end portion of the support rod of the support unit, and has first and second push surfaces. The support units are convertible between a folded state, in which the first end portions of the support rods of the support units are proximate to the axial line, the second end portions of the support rods of the support units are proximate to the axial line, the first push surface of each of the push members of the support units faces the second push surface of an adjacent one of the push members, and the second push surface of each of the push members faces the first push surface of the other adjacent one of the push members, and an unfolded state, in which the first end portions of the support rods of the support units are distal from the axial line, and the second end portions of the support rods of the support units are distal from the axial line. Rotation of any one of the support rods of the support units relative to the pivot seat unit drives a circumferentially adjacent one of the support rods to rotate, such that when any one of the support rods is rotated relative to the pivot seat unit about the central line of the respective one of the pivot pins, the others of the support rods are in turn driven to rotate relative to the pivot seat unit so as to convert the support units between the folded state and the unfolded state. The sitting unit includes a sitting set that is connected to the support rod of one of the support units, and a linkage set that is connected to the connecting member of the pivot seat unit and that is for being driven by the sitting set. The sitting set is operable to drive the linkage set so as to rotate the support rod of the one of the support units and the pivot seat unit relative to each other, and to convert the support units between the folded state and the unfolded state.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
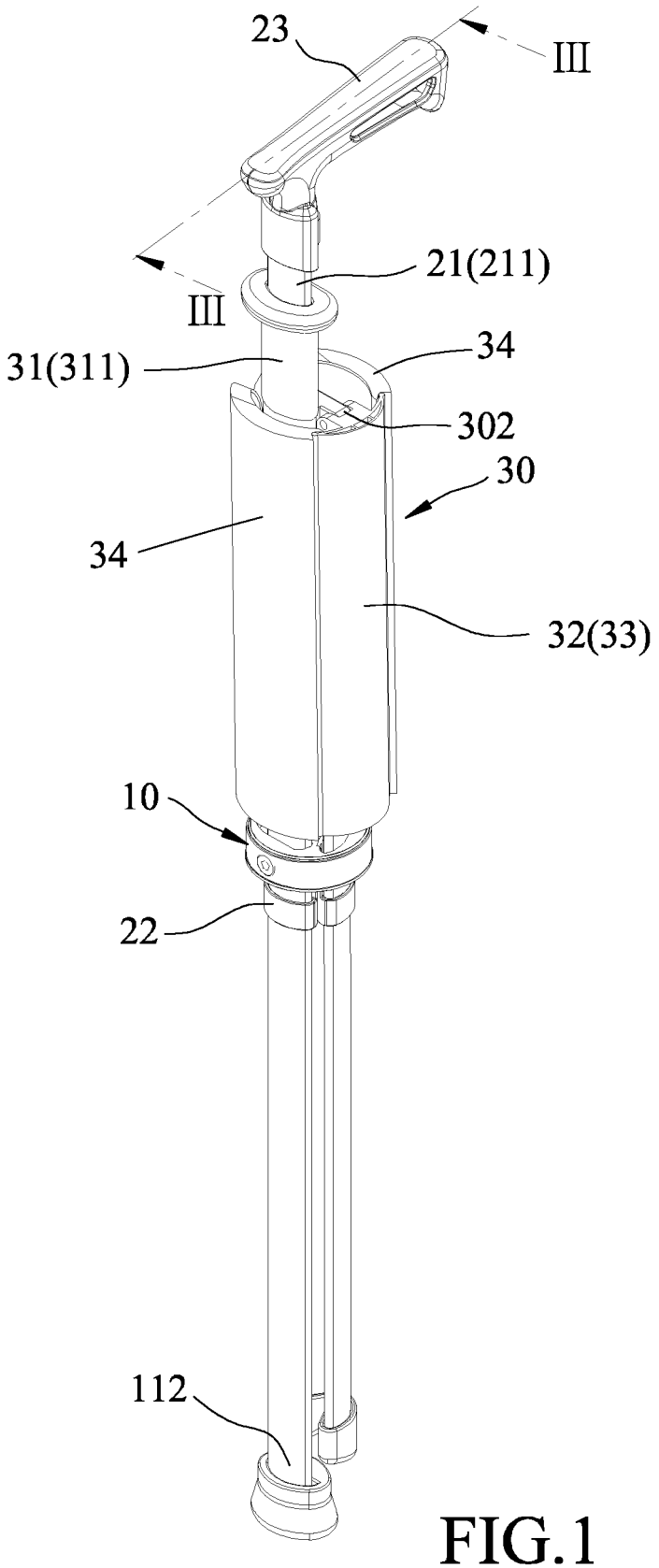
FIG. 1 is a perspective view illustrating a first embodiment of a foldable chair according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
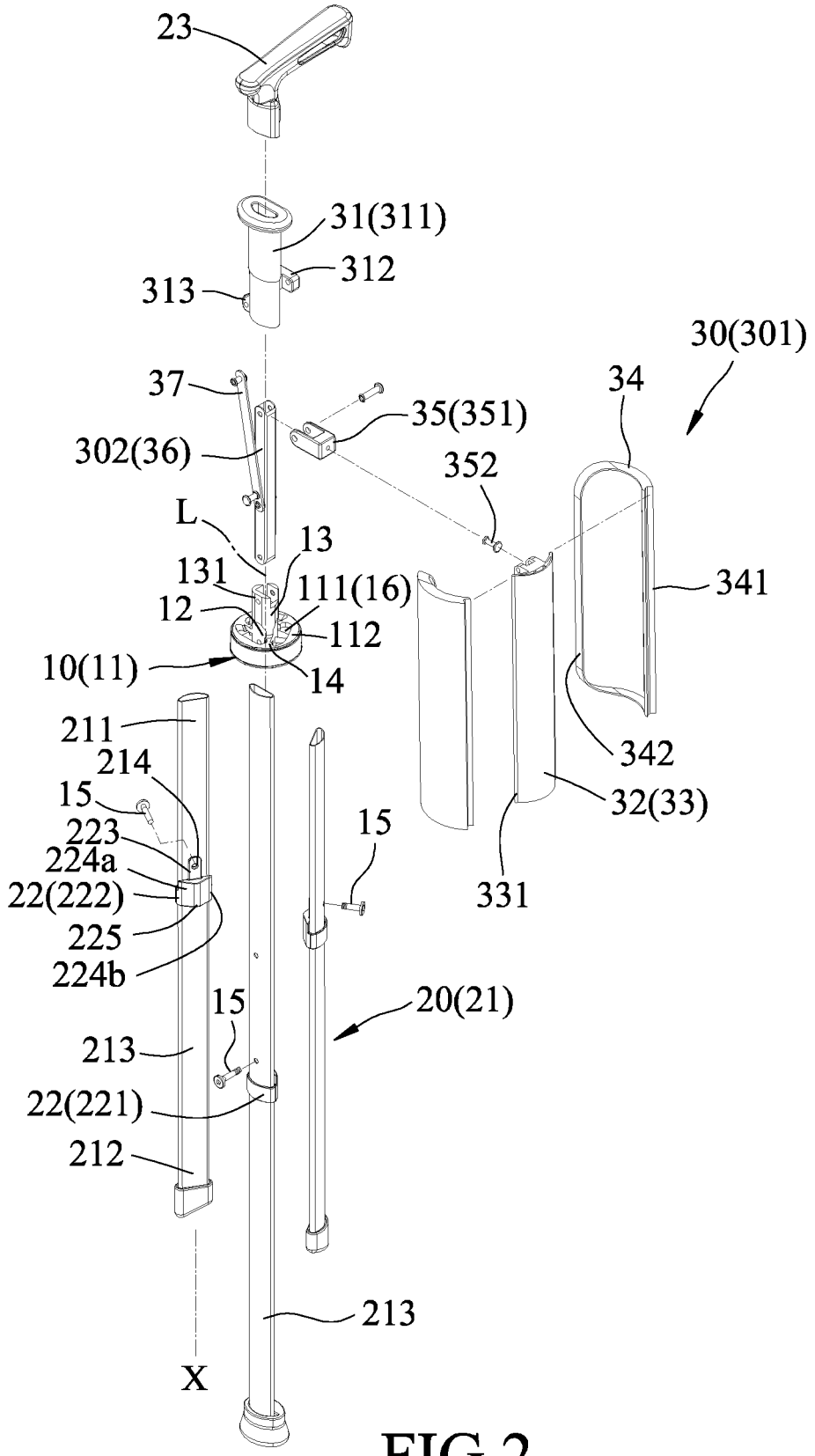
FIG. 2 is a partly exploded perspective view illustrating the first embodiment.

Referring to FIGS. 1 and 2, the first embodiment of a foldable chair according to the disclosure includes a pivot seat unit 10, three support units 20 and a sitting unit 30.

Figure 4:
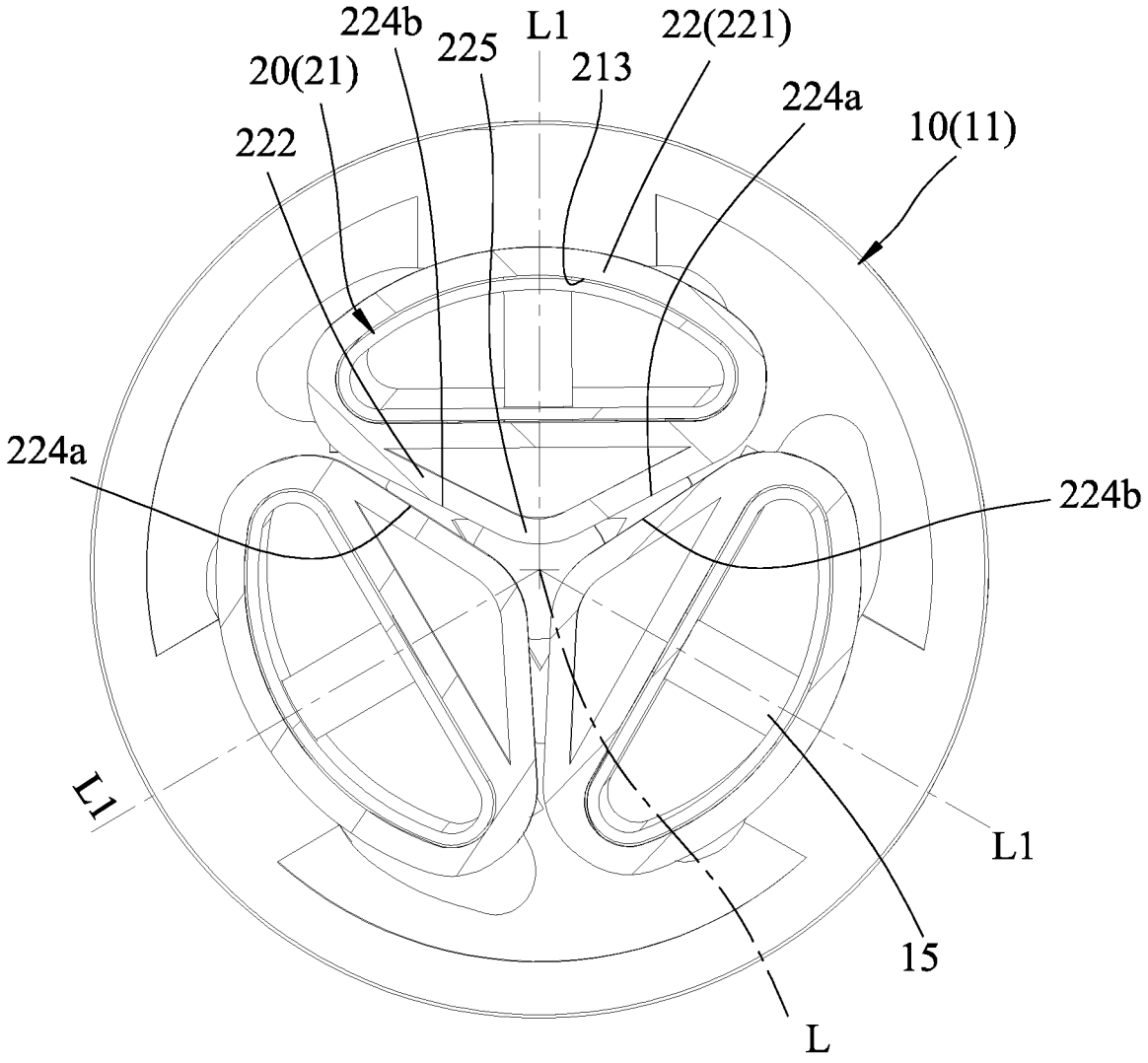
FIG. 4 is a section view taken along line IV-IV in FIG. 3.
Figure 5:
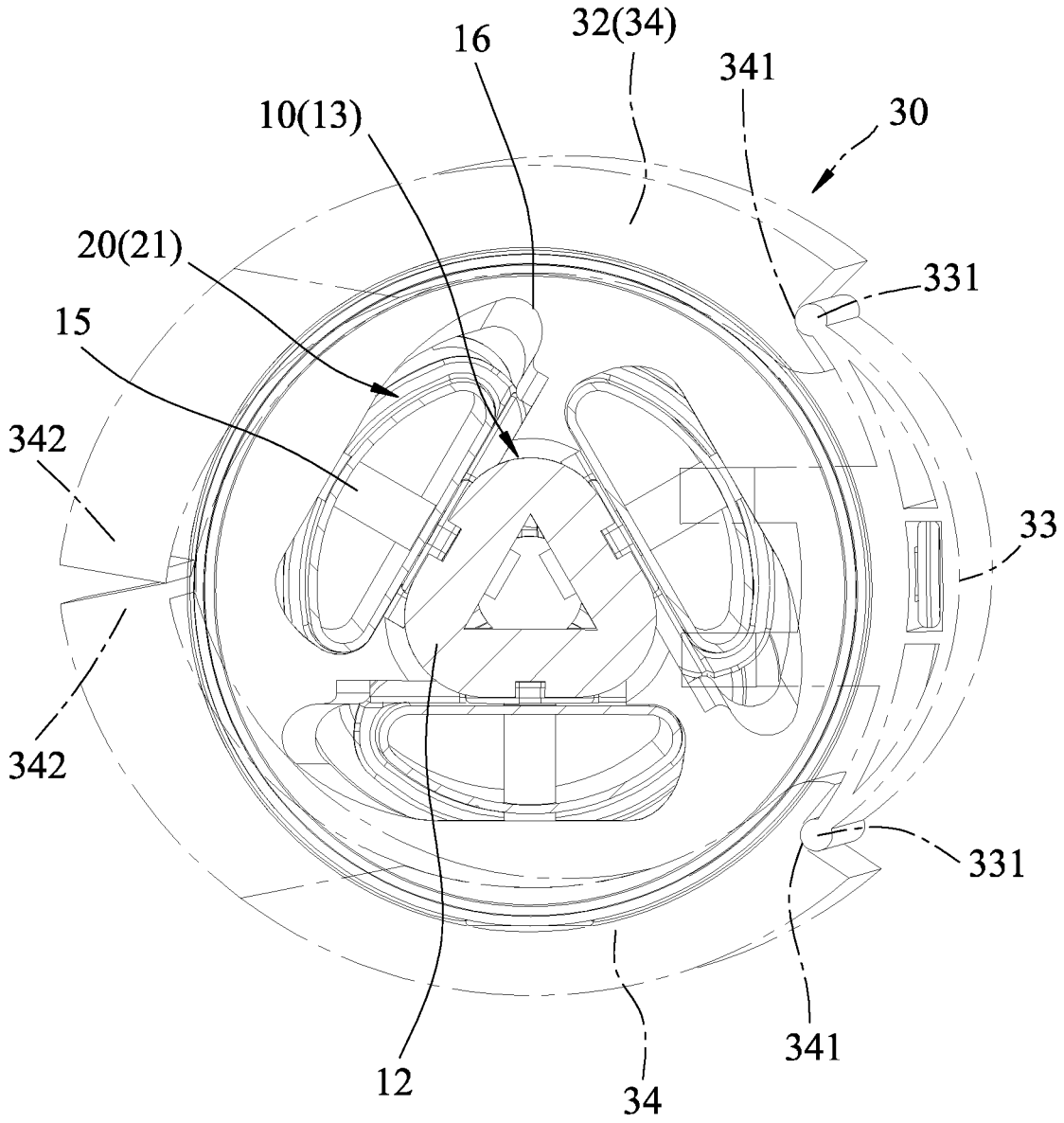
FIG. 5 is a section view taken along line V-V in FIG. 3.
Figure 6:
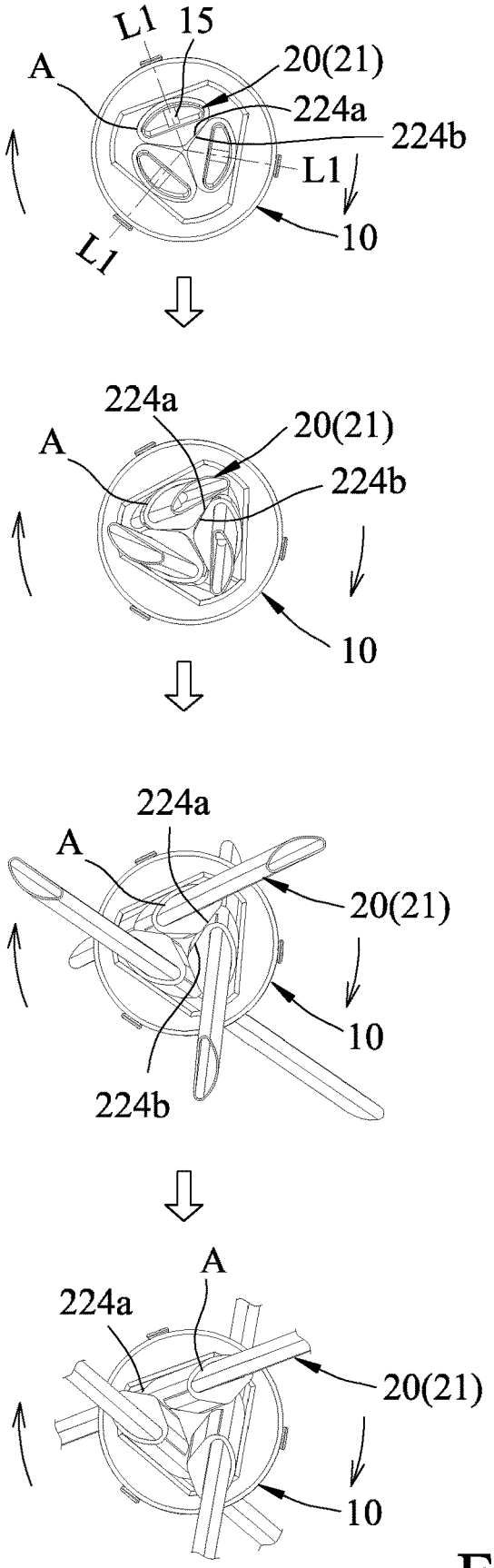
FIG. 6 illustrates conversion of support units of the first embodiment from a folded state to an unfolded state.
Figure 7:
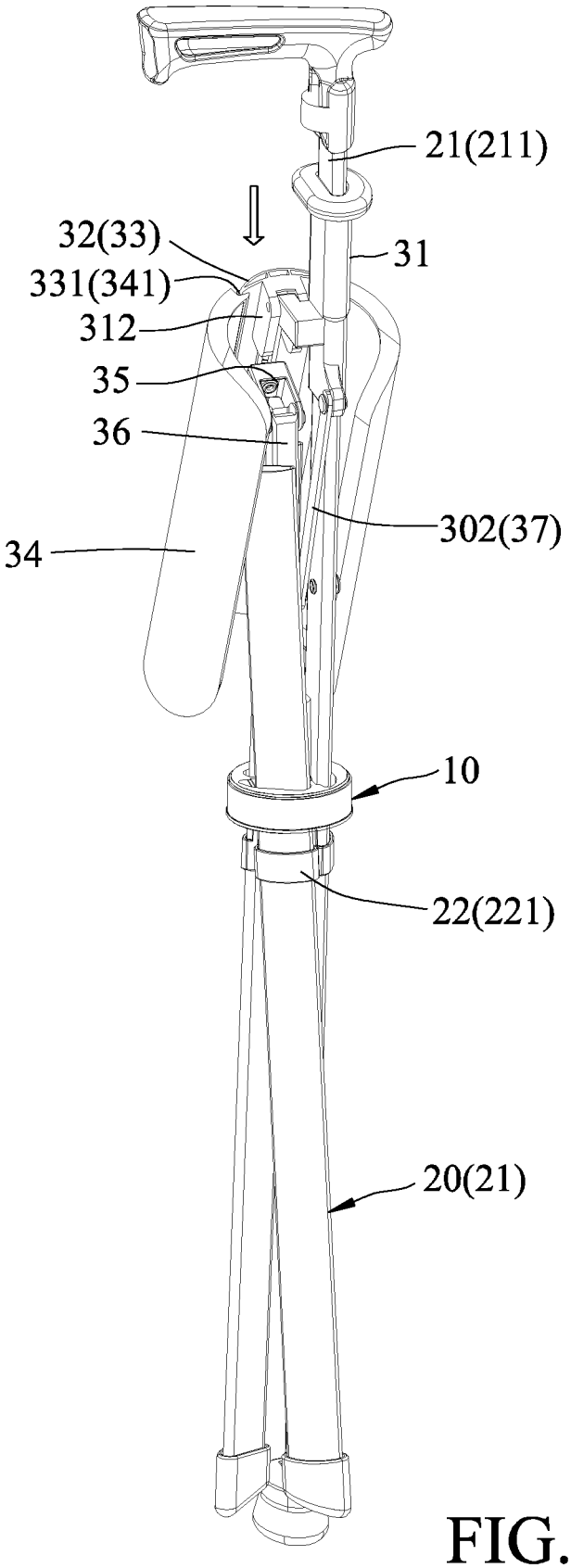
FIG. 7 is a perspective view illustrating the first embodiment.
Figure 10:
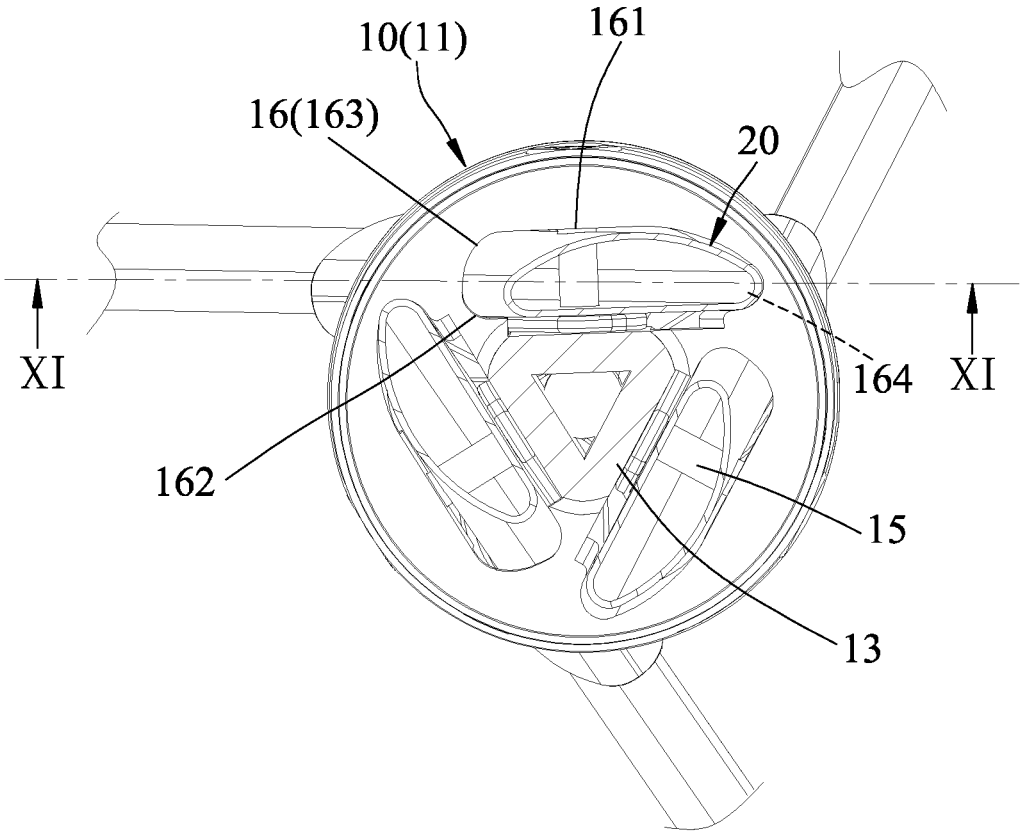
FIG. 10 is a fragmentary sectional view taken along line X-X in FIG. 9.
Figure 11:
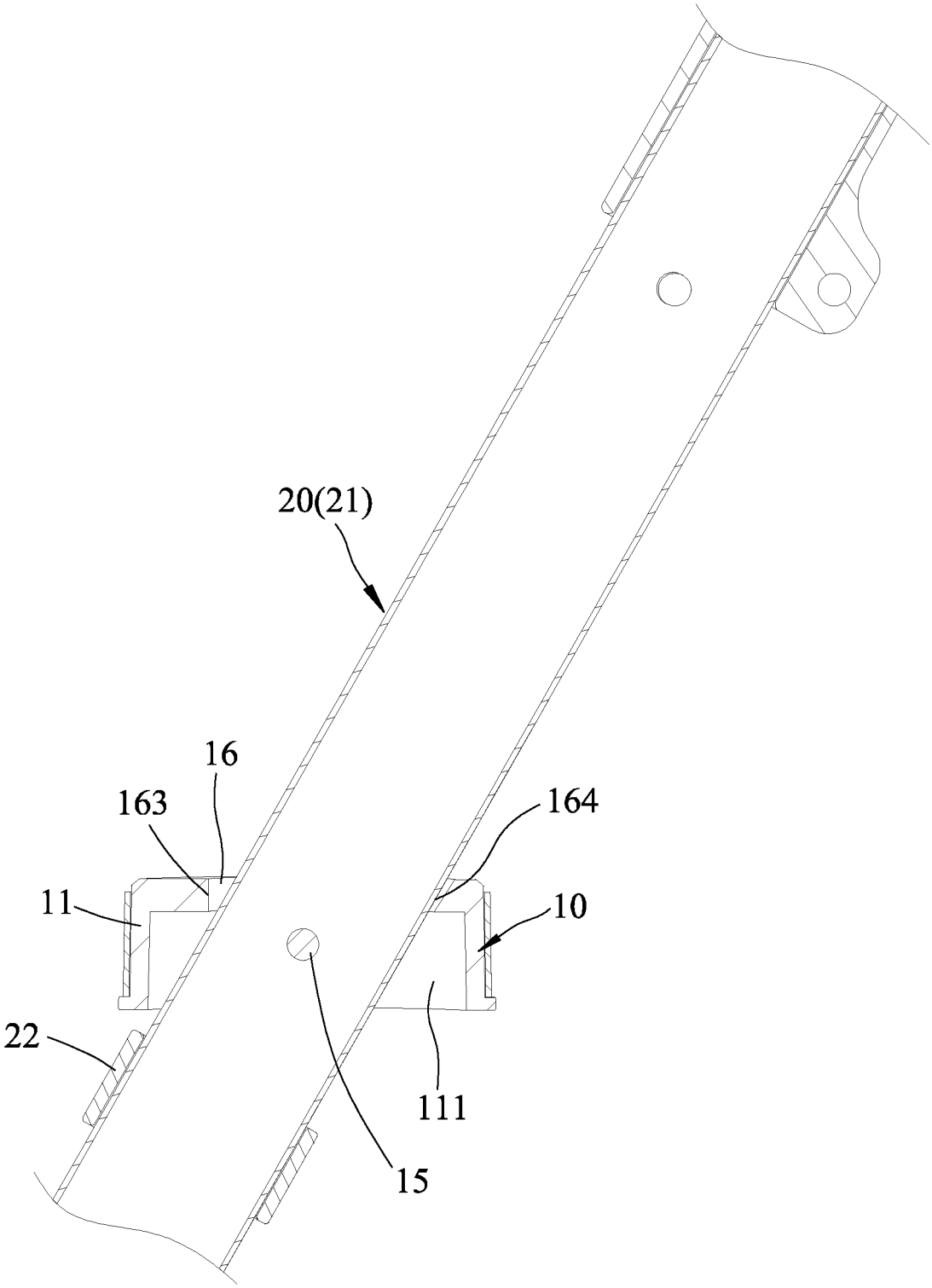
FIG. 11 is a fragmentary sectional view taken along line XI-XI in FIG. 10.

The pivot seat unit 10 includes an outer surrounding seat 11 that surrounds an axial line (L), an inner surrounding seat 12 that extends along the axial line (L) and that is positioned relative to the outer surrounding seat 11, a connecting member 13 that extends along the axial line (L) and that is connected to the inner surrounding seat 12, a plurality of connecting ribs 14 each of which is connected between the inner surrounding seat 12 and the outer surrounding seat 11, and a plurality of pivot pins 15 that are equi-angularly spaced apart from each other about the axial line (L). The outer surrounding seat 11 of the pivot seat unit 10 includes an outer surrounding wall 112 that cooperates with the inner surrounding seat 12 to define an annular space 111 therebetween and that surrounds the support units 20. The annular space 111 is divided into three equi-angularly spaced-apart pivot grooves 16 by the connecting ribs 14. Each of the pivot pins 15 is connected between the outer surrounding wall 112 and the inner surrounding seat 12, and has a central line (L1) (see FIG. 4) that is orthogonal to the axial line (L). In this embodiment, a cross-section of the inner surrounding seat 12 when examined perpendicularly to the axial line (L) has an outer contour that is substantially an equilateral triangle (see FIGS. 5 and 10). Each of the pivot grooves 16 is defined by an outer groove surface 161 that is formed on the outer surrounding wall 112, an inner groove surface 162 that is formed on the inner surrounding seat 12, a first side groove surface 163 that is upright and that is connected between the outer groove surface 161 and the inner groove surface 162, and a second side groove surface 164 that is inclined (see FIGS. 10 and 11) and that is connected between the outer groove surface 161 and the inner groove surface 162. The connecting member 13 has a pivot end 131 (see FIG. 2) at a top end thereof. Each of the pivot pins 15 is connected to the outer surrounding wall, and has an inner section that extends into the annular space 111 and that extends through the respective one of the support units 20.

The support units 20 respectively extend through the pivot grooves 16. Each of the support units 20 includes a support rod 21 that has an extending axis (X), and a push member 22 that is fixedly connected to the support rod 21. The support rod 21 of each of the support units has a D-shaped cross-section when examined perpendicularly to the extending axis (X) (see FIG. 5).

The support rod 21 of each of the support units 20 has a first end portion 211, a second end portion 212 that is opposite to the first end portion 211 along the extending axis (X), an outer surface 213 that extends from the first end portion 211 to the second end portion 212, and a pivot portion 214 (see FIG. 2) that is located between the first end portion 211 and the second end portion 212 and that is pivotally connected to a respective one of the pivot pins 15. The push member 22 of each of the support units 20 is located between the pivot portion 214 and the second end portion 212 of the support rod 21 of the support unit 20, and has a sleeve 221 (see FIG. 4) that is sleeved on the support rod 21, a push block 222 that is fixedly connected to the sleeve 221, and a pivot plate 223 that protrudes from a top end of the push block 222 and that permits the respective one of the pivot pins 15 to extend therethrough. The pivot portion 214 of the support rod 21 of each of the support units 20 corresponds in position to the pivot plate 223 of the push member 22 of the support unit 20. Cross-sections of the push blocks 222 of the support units 20 when examined perpendicularly to the axial line (L) have contours that are identical to each other, and are symmetrical about the axial line (L).

For each of the support units 20, the push block 222 protrudes toward the axial line (L) from the outer surface 213 of the support rod 21, and has first and second push surfaces 224*a*, 224*b*, and an angled portion 225 that is formed between the first and second push surfaces 224*a*, 224*b*. In this embodiment, the angle formed between the first and second push surfaces 224*a*, 224*b* on the same push block 222, ranges from 95 to 105 degrees (see FIG. 4). The first and second push surfaces 224*a*, 224*b* extend from the angled portion 225 toward the outer surface 213 of the support rod 21, and are flat. The surface of the angled portion 225 may be convex, concave or flat. The first end portion 211 of the support rod 21 of one of the support units 20 is mounted with a handle 23.

Figure 3:
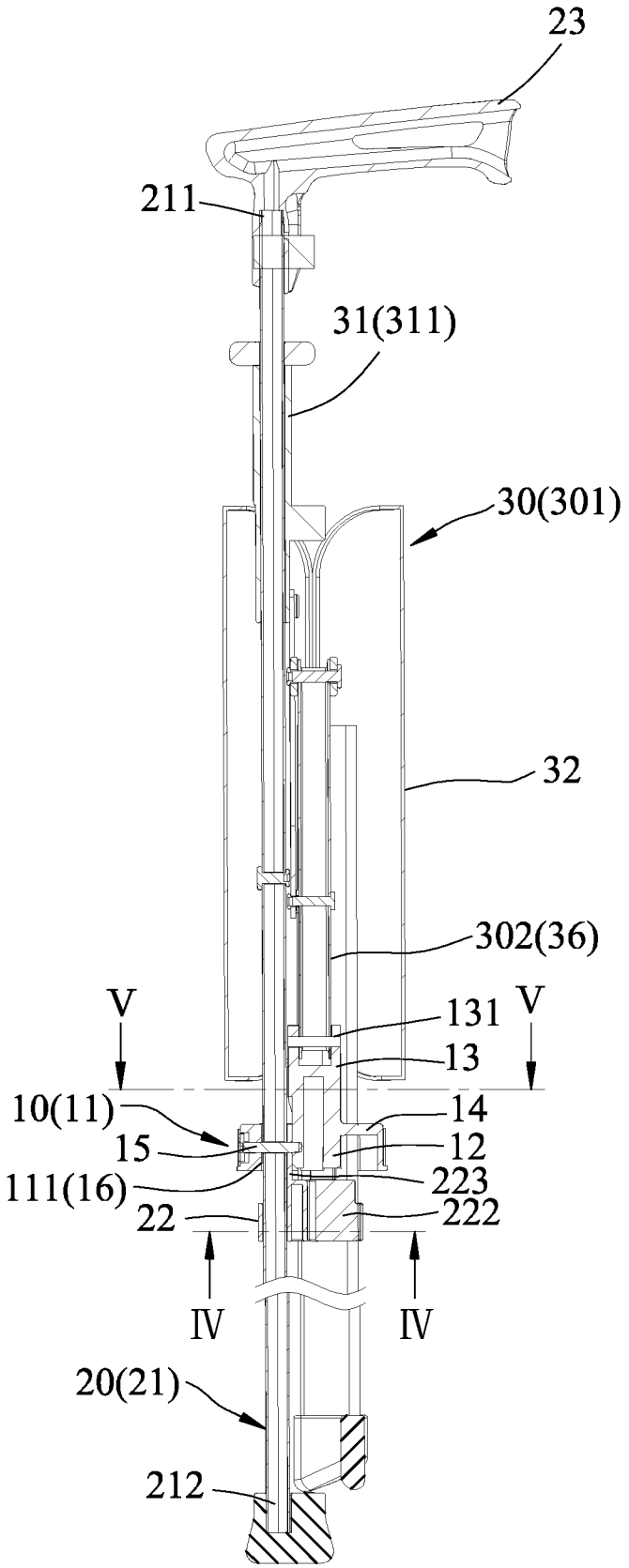
FIG. 3 is a sectional view taken along line III-III in FIG. 1.
Figure 8:
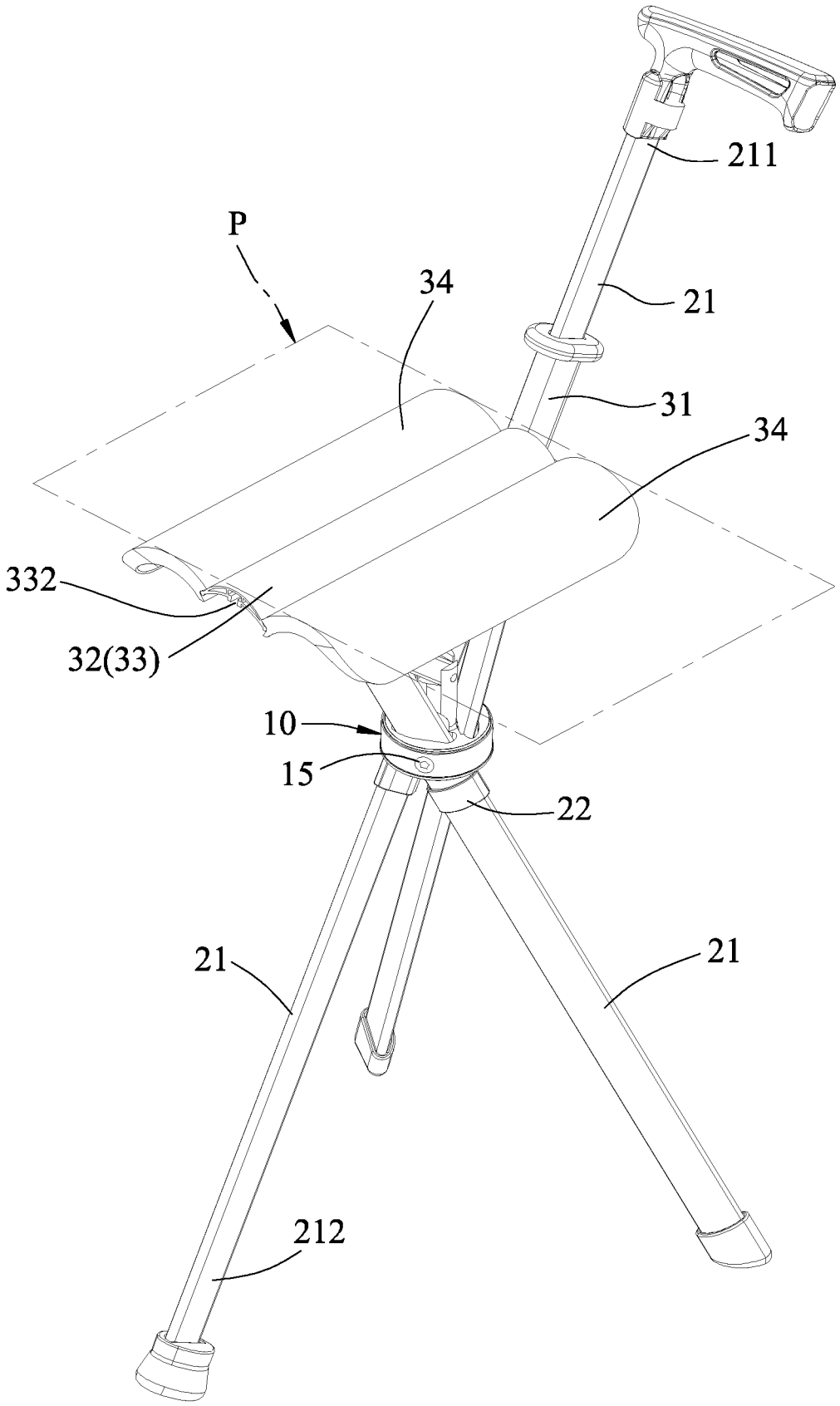
FIG. 8 is a perspective view illustrating the first embodiment unfolded.

The sitting unit 30 includes a sitting set 301 that is connected to the one of the support units 20 mounted with the handle 23, and a linkage set 302 that is connected to the connecting member 13 of the pivot seat unit 10 and that is for being driven by the sitting set 301. The sitting set 301 is operable to drive the linkage set 302 so as to rotate the support rod 21 of the one of the support units 20 and the pivot seat unit 10 relative to each other, and to convert the support units 20 between a folded state (see FIGS. 1, 3 and 5) and an unfolded state (see FIG. 8.)

The sitting set 301 includes a slide seat 31 that is sleeved on and slidable along the support rod 21 of the one of the support units 20, and a plate assembly 32 that is pivotally connected to the slide seat 31 and that is able to be supported by the support rods 21 of the other two of the support units 20. The slide seat 31 has a tube 311, a pivot protrusion 312 disposed on a middle portion of the tube 311, and a lug 313 disposed on a bottom portion of the tube 311.

The plate assembly 32 includes a main plate 33 that is pivotally connected to the pivot protrusion 312 of the slide seat 31, and two side plates 34 that are connected to the main plate 33 and that are able to be respectively supported by the first end portions 211 of the support rods 21 of the other two of the support units 20 not mounted with the handle 23. The main plate 33 has two pivot axles 331 (see FIG. 5) respectively at two opposite lateral sides thereof, and a slide groove 332 (see FIG. 8) that is located between the pivot axles 331 and that is configured as a T-groove. Each of the side plates 34 has a pivot slot 341 that is engaged with a respective one of the pivot axles 331 of the main plate 33, and an outer edge 342 that is opposite to the pivot slot 341. Each of the first end portions 211 of the support rods 21 of the other two of the support units 20 not mounted with the handle 23 is able to support a middle portion of the outer edge 342 of the respective one of the side plates 34.

Figure 9:
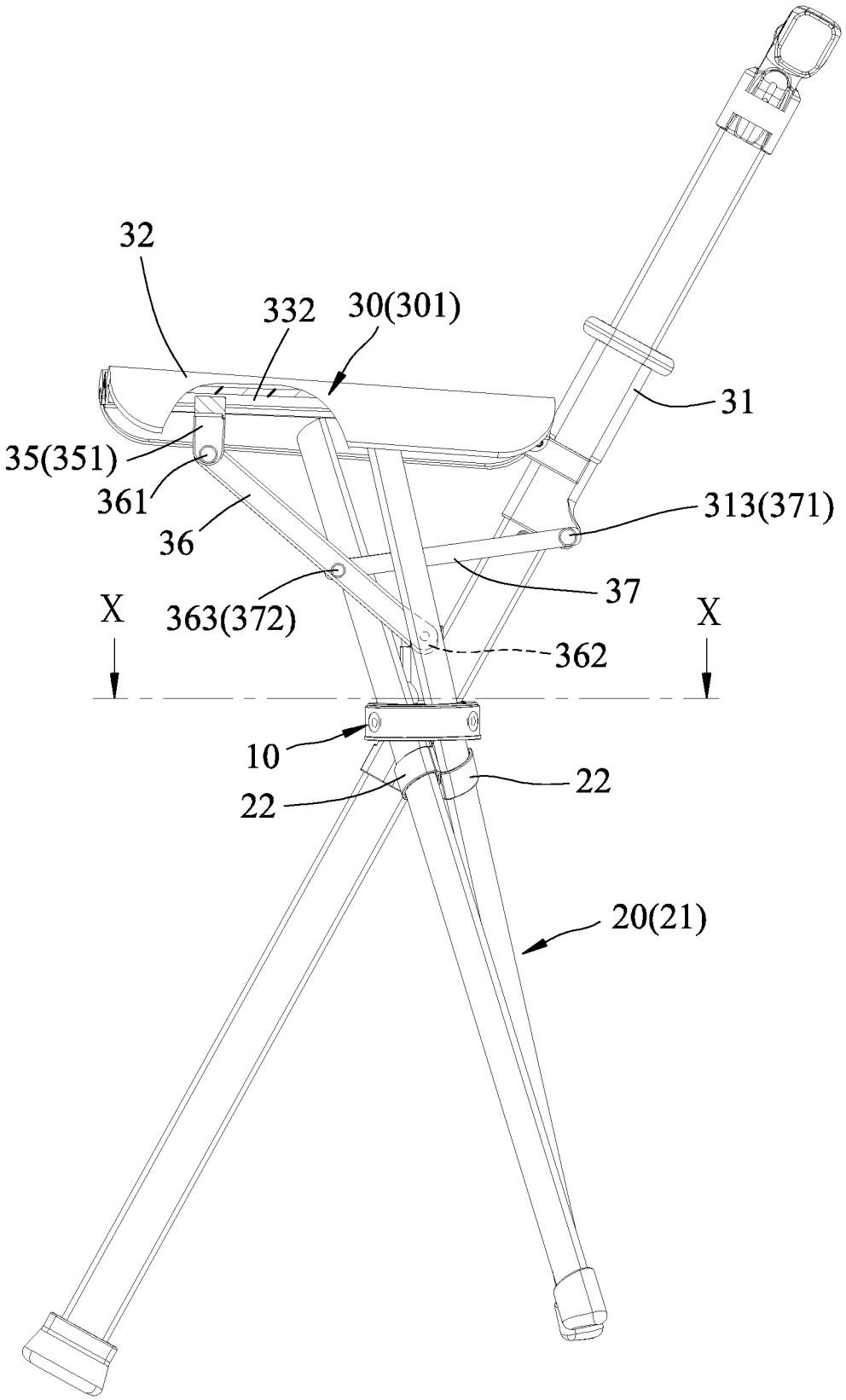
FIG. 9 is a partly sectional view illustrating the first embodiment.

With further reference to FIG. 9, the linkage set 302 includes a slide block 35 that slidably engages the slide groove 332 of the main plate 33 of the plate assembly 32, a first linking bar 36 that is pivotally connected between the slide block 35 and the connecting member 13 of the pivot seat unit 10, and a second linking bar 37 that is pivotally connected between the first linking bar 36 and the slide seat 31. The slide block 35 has a U-shaped main body 351, and a T-shaped guide member 352 that is connected to the main body 351 and that slidably engages the slide groove 332 of the main plate 33 of the plate assembly 32. The first linking bar 36 has a first upper end 361 that is pivotally connected to the main body 351 of the slide block 35, a first lower end 362 that is opposite to the first upper end 361 and that is pivotally connected to the pivot end 131 of the connecting member 13 of the pivot seat unit 10, and a first pivot portion 363 that is located between the first upper end 361 and the first lower end 362. The second linking bar 37 has a second upper end 371 that is pivotally connected to the lug 313 of the slide seat 31, and a second lower end 372 that is opposite to the second upper end 371 and that is pivotally connected to the first pivot portion 363 of the first linking bar 36.

Rotation of any one of the support rods of the support units relative to the pivot seat unit drives a support rod that is circumferentially adjacent to the rotated support rod to rotate, such that when any one of the support rods is rotated relative to the pivot seat unit about the central line of the respective one of the pivot pins, the other support rods are in turn driven to rotate relative to the pivot seat unit so as to convert the support units between the folded state and the unfolded state.

The operation of the foldable chair according to the disclosure is described as follows:

Referring to FIGS. 1, 3, 4 and 5, when the support units 20 are in the folded state, the push blocks 222 of the support units 20 are arranged such that the first push surface 224*a* of each of the push blocks 222 faces the second push surface 224*b* of an adjacent one of the push blocks 222, and that the second push surface 224*b* of each of the push blocks 222 faces the first push surface 224*a* of the other adjacent one of the push blocks 222. In addition, the first end portions 211 of the support rods 21 are proximate to the axial line (L), the second end portions 212 of the support rods 21 are proximate to the axial line (L), and the angled portions 225 of the push members 22 are proximate to the axial line (L). At this time, the plate assembly 32 is in a folded state in which: a distal end of the main plate 33 is proximate to the axial line (L); and the side plates 34 are pivotally connected to the main plate 33, and cooperate with the main plate 33 to form a barrel-shaped structure.

Referring to FIGS. 6 to 11, when a user moves the slide seat 31 along the support rod 21 of the one of the support units 20 mounted with the handle 23 toward the pivot seat unit 10, the pivot seat unit 10 is driven by the slide seat 31 via the second linking bar 37 and the first linking bar 36, so that the pivot seat unit 10 and the support rod 21 of the one of the support units 20 rotate relative to each other. When the support rod 21 of the one of the support units 20 rotates about the central line (L1) of the respective one of the pivot pins 15, the first push surface 224*a* of the push member 22 of the one of the support units 20 pushes the second push surface 224*b* of the push member 22 of an adjacent support unit 20 to rotate the support rod 21 of the adjacent support unit 20 about the central line (L1) of the pivot pin 15 to which the support rod 21 of the adjacent support unit 20 is connected, and the support rod 21 of another support unit 20 next to the adjacent support unit 20 is rotated by the first push surface 224*a* of the adjacent support unit 20 in a manner similar to the above. As such, the support units 20 are converted into the unfolded state, in which the first end portions 211 of the support rods 21 are distal from the axial line (L), and the second end portions 212 of the support rods 21 are distal from the axial line (L). At the same time, the main plate 33 of the plate assembly 32 is pushed by the first linking bar 36 (via the slide block 35) to rotate relative to the slide seat 31 so that the plate assembly 32 is converted into an unfolded state, in which: the distal end of the main plate 33 is distal from the axial line (L); the side plates 34 are pivotally connected to the main plate 33; the side plates 34 cooperate with the main plate 33 to define a support plane (P, see FIG. 8); the slide block 35 is distal from the slide seat 31 (see FIG. 9); the main plate 33 is supported by the first linking bar 36; and the side plates 34 are respectively supported by the support rods 21 of the other two of the support units 20. The support plane (P) cooperates with the support rod 21 of the one of the support units 20 mounted with the handle 23 to form an angle. During the conversion of the plate assembly 32 toward the unfolded state, the guide member 352 is driven by the first linking bar 36 to move along the slide groove 332 of the main plate 33.

Then, when the user moves the slide seat 31 along the support rod 21 of the one of the support units 20 away from the pivot seat unit 10, the plate assembly 32 is converted into the folded state by the slide seat 31 via the linkage set 302. At the same time, the pivot seat unit 10 and the support rod 21 of the one of the support units 20 are rotated relative to each other by the slide seat 31 via the linkage set 302, and the support rods 21 of the others of the support units 20 are in turn driven to rotate such that the support units 20 are converted into the folded state. When the plate assembly 32 is in the folded state, the slide block 35 is proximate to the slide seat 31 (see FIG. 7).

In addition, manually rotating the plate assembly 32 relative to the slide seat 31 may also drive the pivot seat unit 10 and the support rod 21 of the one of the support units 20 to rotate relative to each other (via the linkage set 302), so as to convert the support units 20 between the folded state and the unfolded state.

In summary, the support units 20 can be converted between the folded state and the unfolded state by simply moving the slide seat 31 along the support rod 21 of the one of the support units 20, or by simply rotating the plate assembly 32 relative to the slide seat 31. When any one of the support rods 21 of the support units 20 is rotated relative to the pivot seat unit 10 (see the support rod 21 labeled "A" in FIG. 6), the others of the support rods 21 are in turn driven to rotate relative to the pivot seat 10. It can be observed that the conversion of the foldable chair according to the disclosure is autonomously completed after rotating an initial support rod 21. It should be noted that, when the support units 20 are in the unfolded state, each of the support rods 21 is steadily supported by the second side groove surface 164 that partially defines the respective one of the pivot grooves 16 through which the support rod 21 extends.

In one embodiment, the angled portion 225 of the push member 22 of each of the support units 20 may serve to supplementally push the push member 22 of the adjacent support unit 20 during the conversion of the support units 20 between the folded state and the unfolded state.

Figure 12:
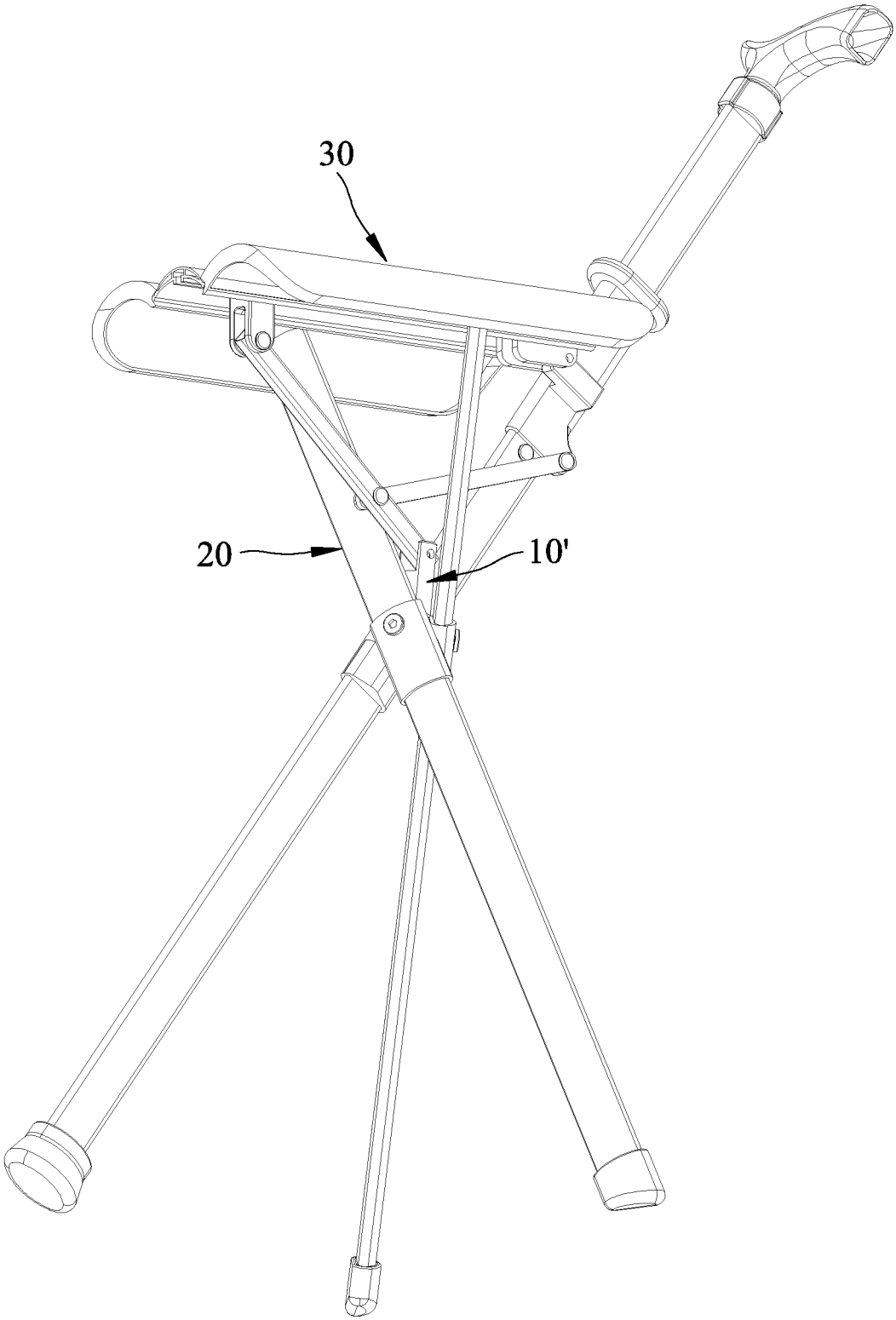
FIG. 12 is a perspective view illustrating a second embodiment of the foldable chair according to the disclosure.
Figure 13:
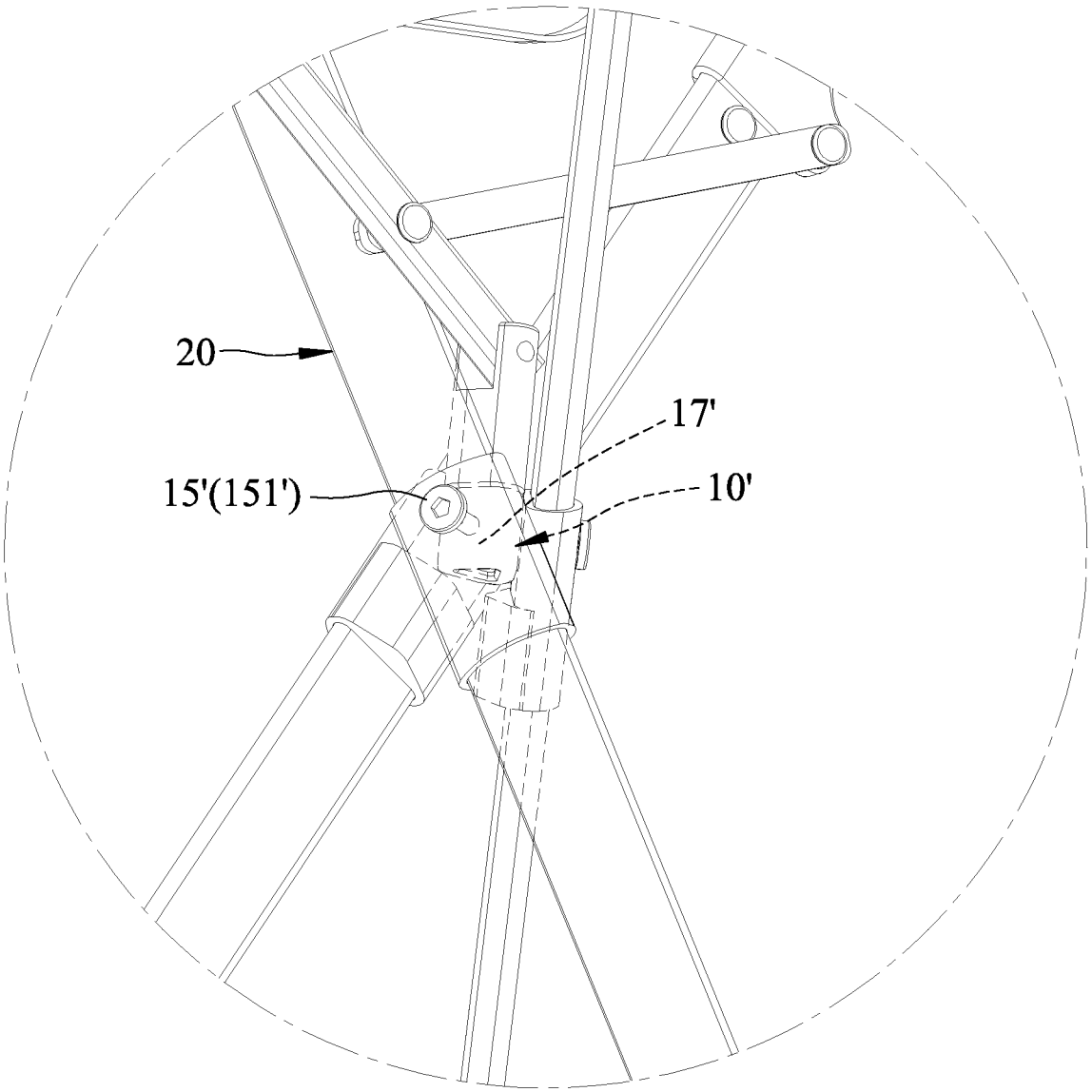
FIG. 13 is an enlarged view illustrating a portion of the second embodiment.
Figure 14:
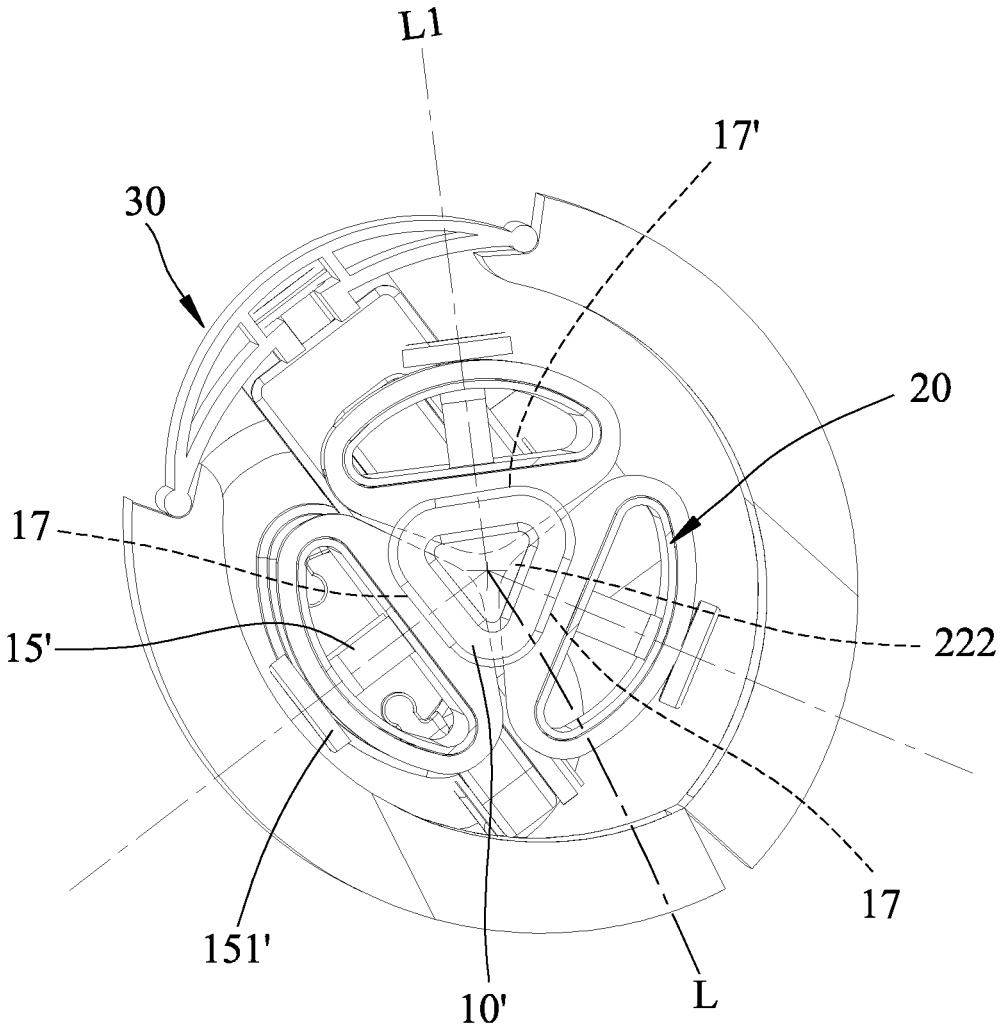
FIG. 14 is a bottom view illustrating the second embodiment.

Referring to FIGS. 12 to 14, the second embodiment of the foldable chair according to the disclosure includes a pivot seat unit 10', three support units 20 and a sitting unit 30. The differences between the first and second embodiments are that: the pivot seat unit 10' is configured as a substantially triangular tube; a cross-section of the pivot seat unit 10' when examined perpendicularly to the axial line (L) has an outer contour that is substantially an equilateral triangle; and the pivot seat unit 10' has three abutment surfaces 17' that surround the axial line (L), and three pivot pins 15' that respectively and perpendicularly project from the abutment surfaces 17'. The support units 20 surround the pivot seat unit 10', and are respectively and pivotally connected to the pivot pins 15'. Each of the pivot pins 15' has an outer end portion 151' located at one side of the respective one of the support units opposite to the pivot seat unit 10'. The cross-sections of the push blocks 222 of the support units 20 when examined perpendicularly to the axial line (L) have contours that are identical to each other, and are symmetrical about the axial line (L). Each of the pivot pins 15' has a central line (L1) that intersects the axial line (L). The second embodiment has same functionality and achieves same results as the first embodiment.

Figure 15:
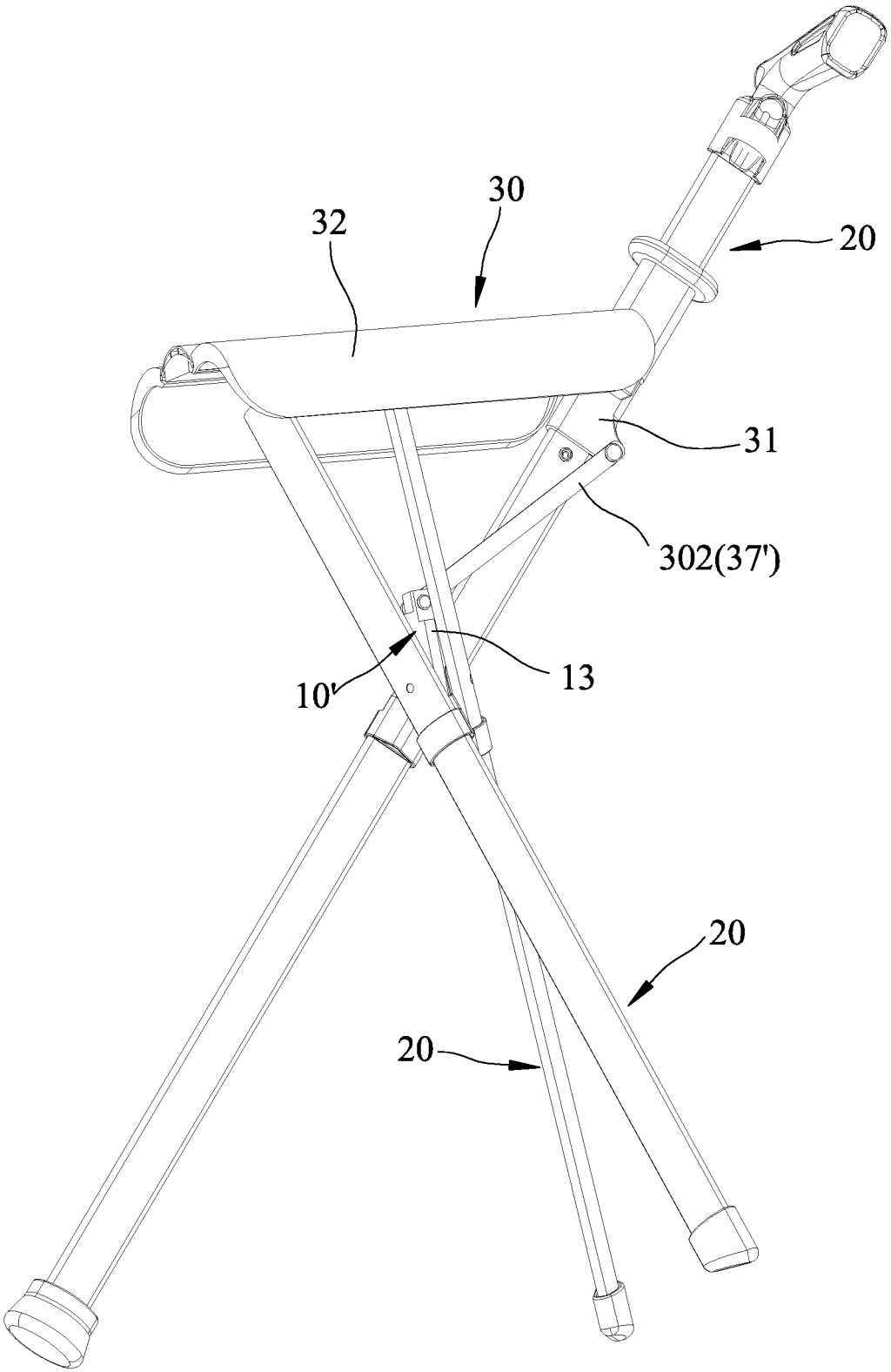
FIG. 15 is a perspective view illustrating a third embodiment of the foldable chair according to the disclosure.

Referring to FIG. 15, the third embodiment of the foldable chair according to the disclosure is different from the second embodiment in that the linkage set 302 of the sitting unit 30 only includes a linking bar 37' that is pivotally connected between the slide seat 31 and the connecting member 13 of the pivot seat unit 10. When a user moves the slide seat 31 along the one of the support units 20 to which the sitting unit 30 is mounted, the pivot seat unit 10 and the one of the support units 20 are driven to rotate relative to each other via the linking bar 37', and the other support units 20 are in turn driven to rotate relative to the pivot seat unit 10, so as to convert the support units 20 between the folded state and the unfolded state.

Figure 16:
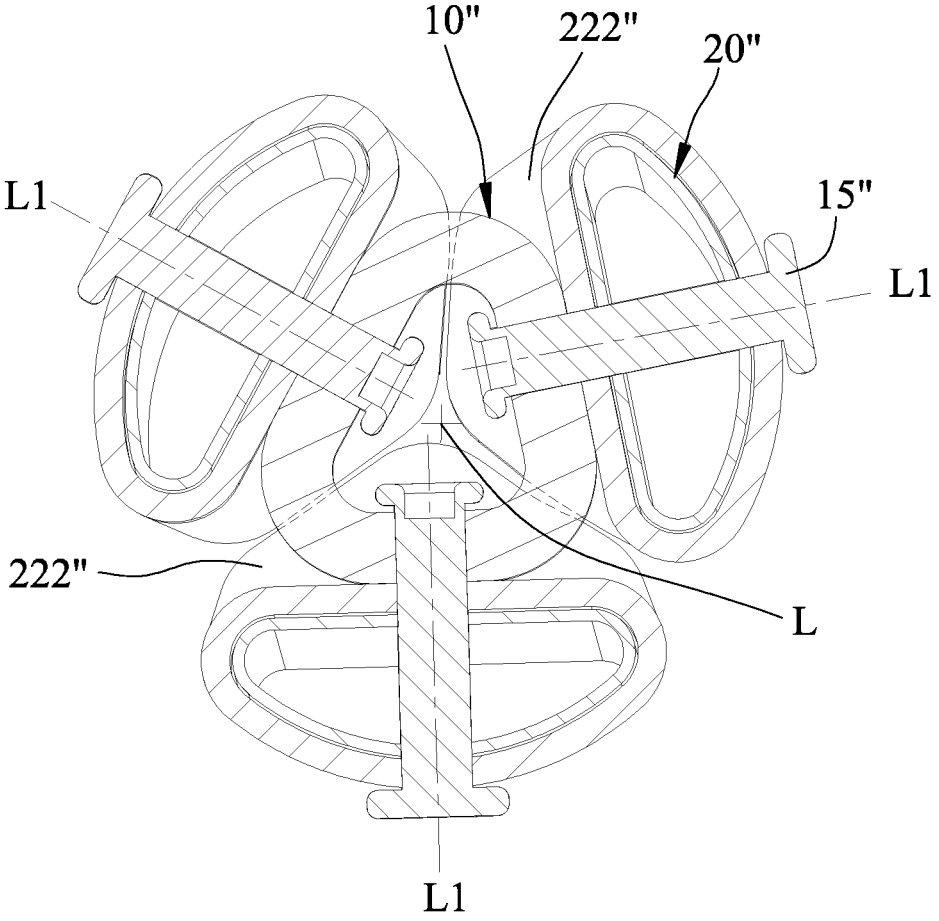
FIG. 16 is a sectional view illustrating a fourth embodiment of the foldable chair according to the disclosure.

Referring to FIG. 16, the fourth embodiment of the foldable chair according to the disclosure is different from the second embodiment in that: a cross-section of the pivot seat unit 10" when examined perpendicularly to the axial line (L) has an outer contour that is substantially a non-equilateral triangle; at least one of the cross-sections of the push blocks 222" of the support units 20" when examined perpendicularly to the axial line (L) has a contour that is not identical to those of the other ones of the cross-sections of the push blocks 222", such that the cross-sections of the push blocks 222" are not symmetrical about the axial line (L); and at least one of the pivot pins 15" has a central line (L1) that does not intersect the axial line (L). The fourth embodiment has the same functionality and achieves the same results as the abovementioned embodiments.

Figure 17:
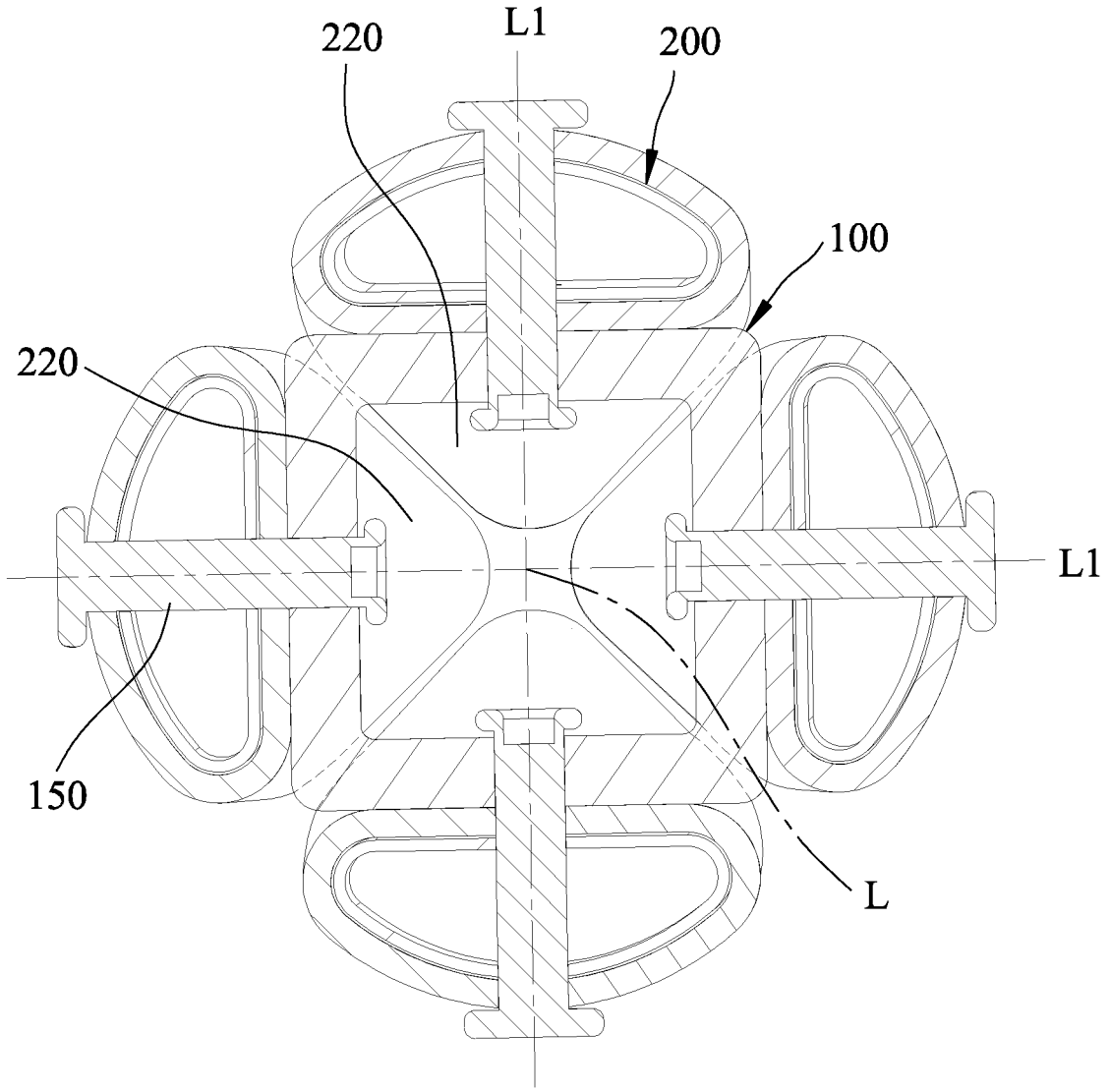
FIG. 17 is a sectional view illustrating a fifth embodiment of the foldable chair according to the disclosure.

Referring to FIG. 17, the fifth embodiment of the foldable chair according to the disclosure is different from the second embodiment in that: the pivot seat unit 100 is substantially configured as a rectangular tube; the cross-sections of the push blocks 220 of the support units 200 when examined perpendicularly to the axial line (L) have contours that are identical to each other, and are symmetrical about the axial line (L); and each of the pivot pins 150 has a central line (L1) that intersects the axial line (L). The fifth embodiment has the same functionality and achieves the same results as the abovementioned embodiments.

In another application of the foldable chair, the sitting unit 30 may be omitted, and the pivot seat unit 10 and the support units 20 cooperatively serve as a folding mechanism that is convertible between a folded state and an unfolded state (with reference to the folded and unfolded states of the foldable chair). When the folding mechanism is in the unfolded state, top ends of the support units 20 cooperate with each other for supporting a holder/container of objects.

Figure 18:
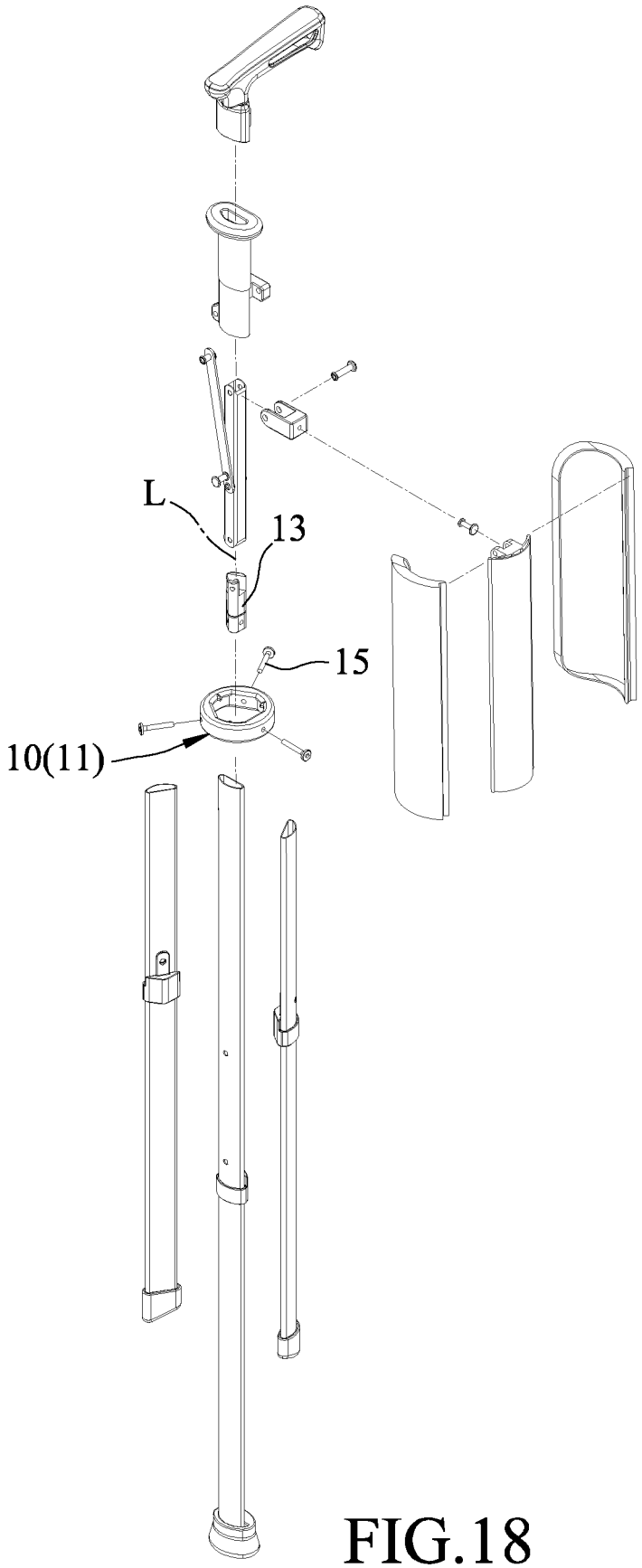
FIG. 18 is a partly exploded perspective view illustrating a modification of the first embodiment.

Referring to FIG. 18, in a modification of the first embodiment, the connecting ribs 14 and the inner surrounding seat 12 (see FIG. 2) of the pivot seat unit 10 are omitted, and the connecting member 13 is positioned relative to the outer surrounding seat 11 by the pivot pins 15.

Figure 19:
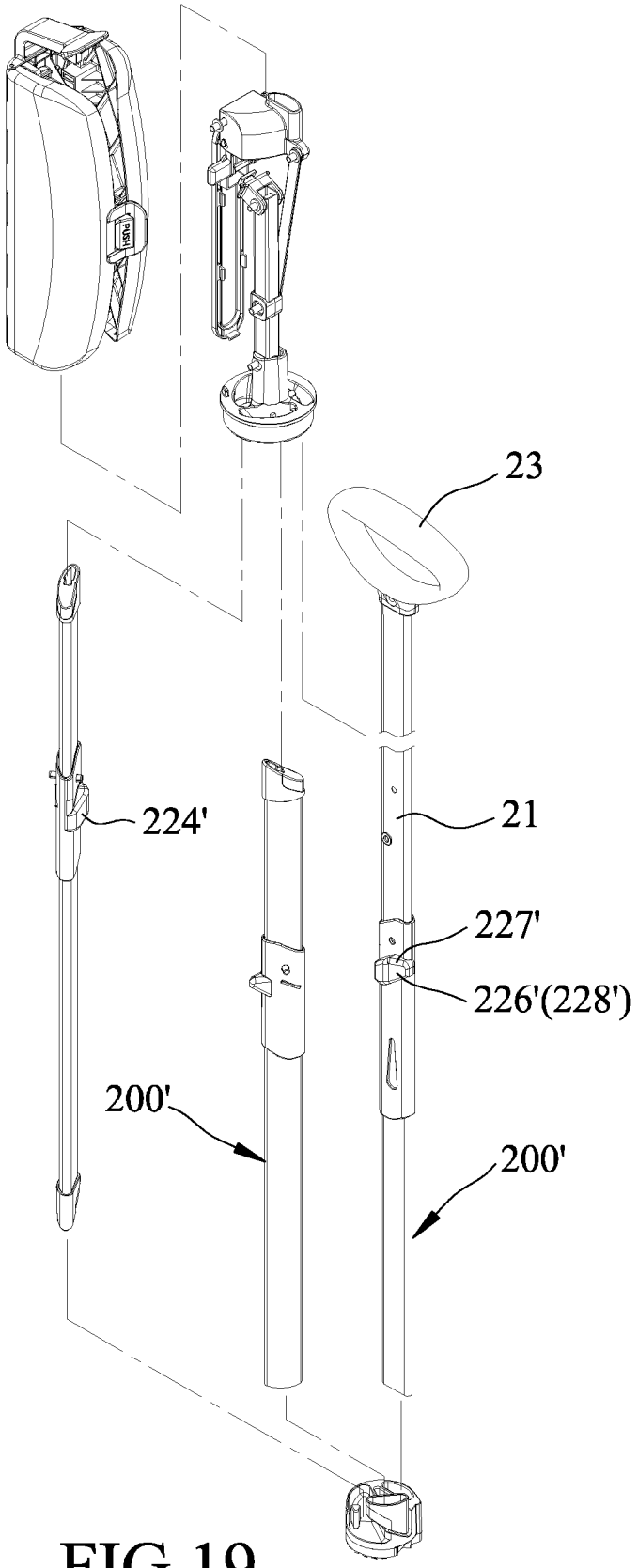
FIG. 19 is a partly exploded perspective view illustrating a sixth embodiment of the foldable chair according to the disclosure.
Figure 20:
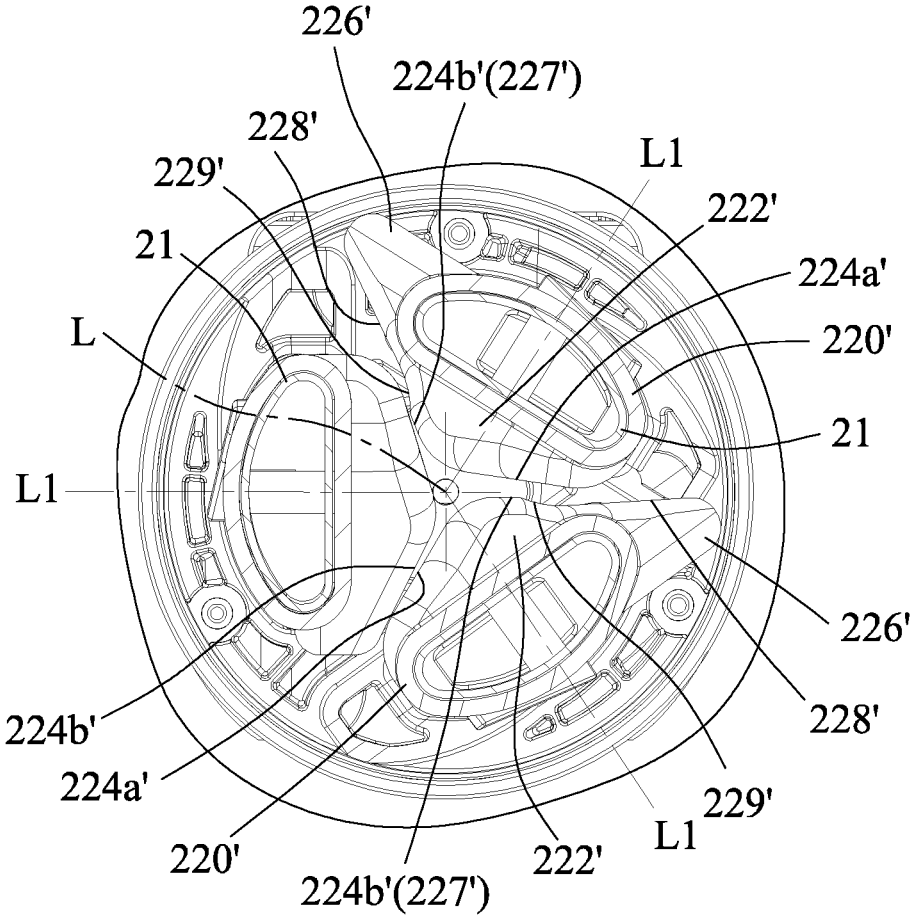
FIG. 20 is a sectional view illustrating the support units of the sixth embodiment in a folded state.
Figure 21:
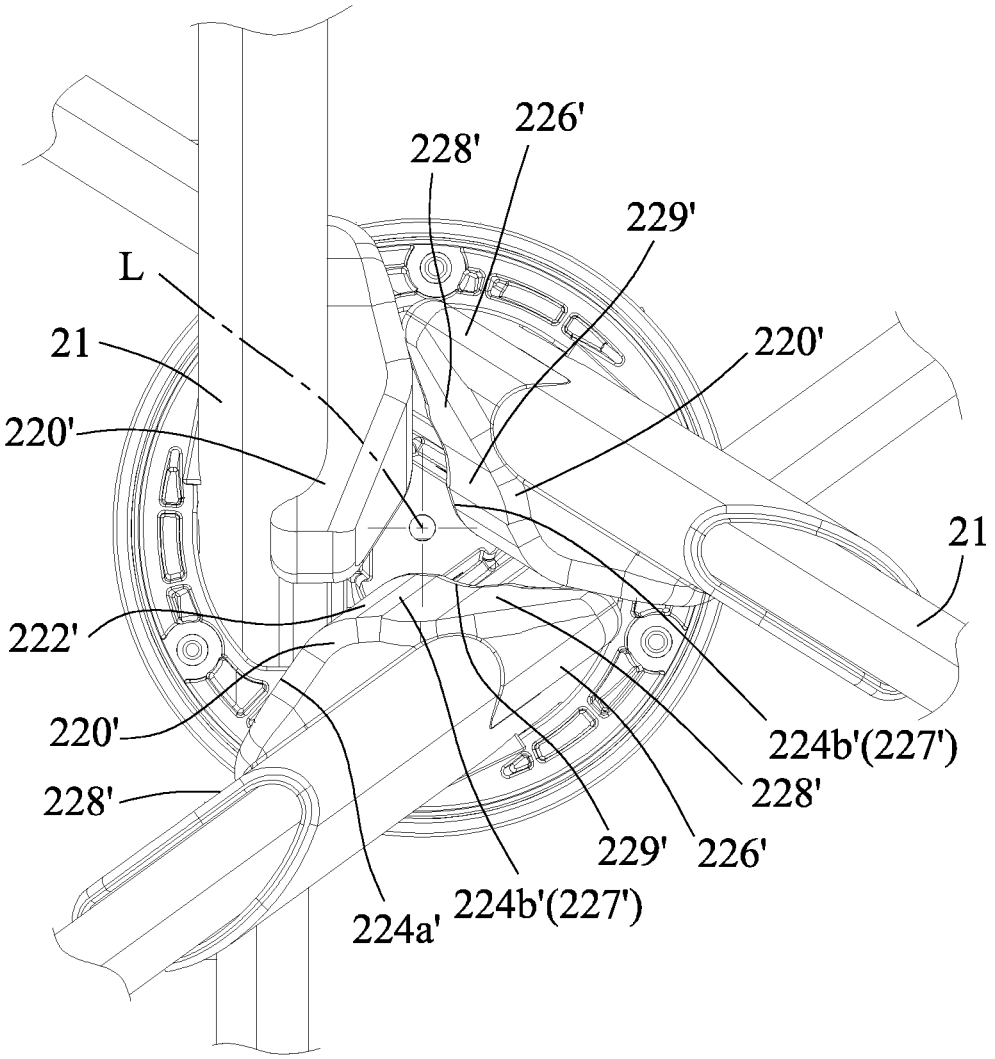
FIG. 21 is a sectional view illustrating the support units of the sixth embodiment in a unfolded state.

Referring to FIGS. 19 to 21, the sixth embodiment of the foldable chair according to the disclosure is different from the first embodiment in that: the push block 222' of the push member 220' of the one of the support units 200' mounted with the handle 23 has an extension 226' that extends away from the first push surface **224*a*' of the push block 222'. The second push surface 224*b*' of the one of the support units 200' has an inner section 227' that is proximate to the first push surface 224*a*' of the one of the support units 200', an outer section 228' that is distal from the first push surface 224*a*' and that corresponds in position to the extension 226', and a concave arc-shaped section 229' that is located between the inner section 227' and the outer section 228'. When the support units 200' are in the unfolded state (see FIG. 21), the outer section 228' abuts against the adjacent support unit 200' to support the adjacent support unit 200'. The concave arc-shaped section 229' serves to prevent interference between the second push surface 224*b*' and the first push surface 224*a*' of the adjacent support unit 200' during conversion of the support units 200' between the folded state and the unfolded state. The push block 222' of another one of the support units 200' proximate to the second push surface 224*b*' of the one of the support units 200' has a structure substantially the same as the push block 222' of the one of the support units 200'**.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure. While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A folding mechanism comprising:

a pivot seat unit including at least three pivot pins that are angularly spaced apart from each other about an axial line, each of said pivot pins having a central line; and at least three support units disposed about the axial line, each of said support units including a support rod that has an extending axis, and a push member that is fixedly connected to said support rod, said support rod of each of said support units having a first end portion, a second end portion that is opposite to said first end portion along the extending axis, and a pivot portion that is located between said first end portion and said second end portion and that is pivotally connected to a respective one of said pivot pins, said push member of each of said support units being located between said pivot portion and said second end portion of said support rod of said support unit, and having first and second push surfaces, said support units being convertible between a folded state and an unfolded state;

wherein, when said support units are in the folded state, said first end portions of said support rods of said support units are proximate to the axial line, said second end portions of said support rods of said support units are proximate to the axial line, and for each of said push members of said support units, said first push surface of said push member faces said second push surface of an adjacent one of said push members, and said second push surface of said push member faces said first push surface of the other adjacent one of said push members;

wherein, when said support units are in the unfolded state, said first end portions of said support rods of said support units are distal from the axial line, and said second end portions of said support rods of said support units are distal from the axial line; and wherein, rotation of any one of said support rods of said support units relative to said pivot seat unit drives a circumferentially adjacent one of said support rods to rotate, such that when any one of said support rods is rotated relative to said pivot seat unit about the central line of the respective one of said pivot pins, the others of said support rods are in turn driven to rotate relative to said pivot seat unit so as to convert said support units between the folded state and the unfolded state.

2. The folding mechanism as claimed in claim 1, wherein the central line of each of said pivot pins of said pivot seat unit is orthogonal to the axial line, said support rod of each of said support units further having an outer surface, said push member of each of said support units further having a push block that protrudes toward the axial line from said outer surface of said support rod of said support unit, that is formed with said first and second push surfaces of said push member, and that has an angled portion formed between said first and second push surfaces, said angled portion of said push member of each of said support units being proximate to the axial line when said support units are in the folded state, said angled portion of said push member of each of said support units pushing said push member of the adjacent support unit during the conversion of said support units between the folded state and the unfolded state.

3. The folding mechanism as claimed in claim 2, wherein, for each of said support units, said first and second push surfaces extend from said angled portion toward said outer surface of said support rod, and are flat.

4. The folding mechanism as claimed in claim 2, wherein said pivot seat unit further includes an outer surrounding wall that defines a space therein and that surrounds said support units, each of said pivot pins being connected to said outer surrounding wall, and having an inner section that extends into said space and that extends through the respective one of said support units.

5. The folding mechanism as claimed in claim 4, wherein said pivot seat unit includes three of said pivot pins that are equi-angularly spaced apart from each other about the axial line, said folding mechanism comprising three of said support units, wherein cross-sections of said push blocks of said support units when examined perpendicular to the axial line have contours that are identical to each other, and that are symmetrical about the axial line, the central line of each of said pivot pins of said pivot seat unit intersecting the axial line.

6. The folding mechanism as claimed in claim 2, wherein said support units surround said pivot seat unit, each of said pivot pins having an outer end portion located at one side of the respective one of said support units opposite to said pivot seat unit.

7. The folding mechanism as claimed in claim 1, wherein said push block of said push member of one of said support units has an extension that extends away from said first push surface of said push block, said second push surface of the one of said support units having an inner section that is proximate to said first push surface of the one of said support units, and an outer section that is distal from said first push surface and that corresponds in position to said extension, said push block of at least one of the others of said support units having a structure substantially the same as said push block of the one of said support units.

8. A foldable chair comprising:

a pivot seat unit including at least three pivot pins that are angularly spaced apart from each other about an axial line, and a connecting member, each of said pivot pins having a central line;

at least three support units disposed about the axial line, each of said support units including a support rod that has an extending axis, and a push member that is fixedly connected to said support rod, said support rod of each of said support units having a first end portion, a second end portion that is opposite to said first end portion along the extending axis, and a pivot portion that is located between said first end portion and said second end portion and that is pivotally connected to a respective one of said pivot pins, said push member of each of said support units being located between said pivot portion and said second end portion of said support rod of said support unit, and having first and second push surfaces, said support units being convertible between a folded state, in which said first end portions of said support rods of said support units are proximate to the axial line, said second end portions of said support rods of said support units are proximate to the axial line, said first push surface of each of said push members of said support units faces said second push surface of an adjacent one of said push members, and said second push surface of each of said push members faces said first push surface of the other adjacent one of said push members, and an unfolded state, in which said first end portions of said support rods of said support units are distal from the axial line, and said second end portions of said support rods of said support units are distal from the axial line, rotation of any one of said support rods of said support units relative to said pivot seat unit drives a circumferentially adjacent one of said support rods to rotate, such that when any one of said support rods is rotated relative to said pivot seat unit about the central line of the respective one of said pivot pins, the others of said support rods are in turn driven to rotate relative to said pivot seat unit so as to convert said support units between the folded state and the unfolded state; and a sitting unit including a sitting set that is connected to said support rod of one of said support units, and a linkage set that is connected to said connecting member of said pivot seat unit and that is for being driven by said sitting set, said sitting set being operable to drive said linkage set so as to rotate said support rod of the one of said support units and said pivot seat unit relative to each other, and to convert said support units between the folded state and the unfolded state.

9. The foldable chair as claimed in claim 8, wherein said sitting set includes a slide seat that is sleeved on and slidable along said support rod of the one of said support units, and a plate assembly that is connected to said slide seat and that is able to be supported by said support rods of the others of said support units, said linkage set being pivotally connected between said slide seat and said connecting member of said pivot seat unit, said support rod of the one of said support units and said pivot seat unit rotating relative to each other during movement of said slide seat toward said pivot seat unit, so that said support units is converted from the folded state to the unfolded state, and that said plate assembly is converted from a folded state, in which a distal end of said plate assembly is proximate to the axial line, to an unfolded state, in which said distal end of said plate assembly is distal from the axial line, said plate assembly cooperating with said support rod of the one of said support units to form an angle when said plate assembly is in the unfolded state.

10. The foldable chair as claimed in claim 8, wherein:

the central line of each of said pivot pins of said pivot seat unit is orthogonal to the axial line, said support rod of each of said support units further having an outer surface, said push member of each of said support units further having a push block that protrudes toward the axial line from said outer surface of said support rod of said support unit, that is formed with said first and second push surfaces of said push member, and that has an angled portion formed between said first and second push surfaces, said angled portion of said push member of each of said support units being proximate to the axial line when said support units are in the folded state, said angled portion of said push member of each of said support units pushing said push member of the adjacent support unit during the conversion of said support units between the folded state and the unfolded state; and for each of said support units, said first and second push surfaces extend from said angled portion toward said outer surface of said support rod, and are flat.

11. The foldable chair as claimed in claim 10, wherein said pivot seat unit further includes an outer surrounding wall that surrounds said support units, said connecting member being positioned relative to said outer surrounding wall, each of said pivot pins being connected to said outer surrounding wall, said pivot seat unit including three of said pivot pins that are equi-angularly spaced apart from each other about the axial line, said folding mechanism comprising three of said support units, wherein cross-sections of said push blocks of said support units when examined perpendicular to the axial line have contours that are identical to each other, and that are symmetrical about the axial line, the central line of each of said pivot pins of said pivot seat unit intersecting the axial line.

12. The foldable chair as claimed in claim 10, wherein said pivot seat unit further includes an outer surrounding seat that surrounds the axial line, an inner surrounding seat that extends along the axial line, that is surrounded by said outer surrounding seat, and that cooperates with said outer surrounding seat to define an annular space therebetween, and a plurality of connecting ribs each of which is connected between said inner surrounding seat and said outer surrounding seat, said connecting member being connected to said inner surrounding seat, each of said pivot pins being connected between said inner surrounding seat and said outer surrounding seat.

13. The foldable chair as claimed in claim 9, wherein said plate assembly includes a main plate that is pivotally connected to said slide seat, and two side plates that are connected to the main plate 33 and that are able to be supported by the others of said support units, said main plate having two pivot axles respectively at two opposite lateral sides thereof, each of said side plates having a pivot slot that is engaged with a respective one of said pivot axles of said main plate, and an outer edge that is opposite to said pivot slot, said first end portions of said support rods of the others of said support units being able to support middle portions of said outer edges of said side plates, said side plates being pivotally connected to said main plate and cooperating with said main plate to define a support plane when said plate assembly is in the unfolded state, said side plates being pivotally connected to said main plate, and cooperating with said main plate to form a barrel-shaped structure when said plate assembly is in the folded state.

14. The foldable chair as claimed in claim 13, wherein said main plate of said plate assembly further has a slide groove that is located between said pivot axles and that is configured as a T-groove, said linkage set including a slide block that slidably engages said slide groove of said main plate of said plate assembly, a first linking bar that is pivotally connected between said slide block and said connecting member of said pivot seat unit, and a second linking bar that is pivotally connected between said first linking bar and said slide seat, said slide block having a U-shaped main body, and a T-shaped guide member that is connected to said main body and that slidably engages said slide groove of said main plate of said plate assembly, said first linking bar having a first upper end that is pivotally connected to said main body of said slide block, a first lower end that is opposite to said first upper end and that is pivotally connected to said connecting member of said pivot seat unit, and a first pivot portion that is located between said first upper end and said first lower end, said second linking bar having a second upper end that is pivotally connected to said slide seat, and a second lower end that is opposite to said second upper end and that is pivotally connected to said first pivot portion of said first linking bar, said slide block being distal from said slide seat when said plate assembly is in said unfolded state, said slide block being proximate to said slide seat when said plate assembly is in said folded state.

15. The folding mechanism as claimed in claim 8, wherein said push block of said push member of one of said support units has an extension that extends away from said first push surface of said push block, said second push surface of the one of said support units having an inner section that is proximate to said first push surface of the one of said support units, and an outer section that is distal from said first push surface and that corresponds in position to said extension, said push block of at least one of the others of said support units having a structure substantially the same as said push block of the one of said support units.

* * * * *